United States Patent [19]
Wulff et al.
[11] 4,158,901
[45] Jun. 26, 1979

[54] MOBILE SURFACE CLEANING MACHINE HAVING SIDE MOUNTED SQUEEGEES

[75] Inventors: Richard F. Wulff, Maple Plain; Everett E. Johnson, Mound, both of Minn.

[73] Assignee: Advance Machine Company, Spring Park, Minn.

[21] Appl. No.: 861,496

[22] Filed: Dec. 16, 1977

[51] Int. Cl.² ..... A47L 7/00
[52] U.S. Cl. ..... 15/401; 15/50 R; 15/320
[58] Field of Search ..... 15/50 R, 50 C, 320, 15/401

[56] References Cited

U.S. PATENT DOCUMENTS

| | | | |
|---|---|---|---|
| 3,277,511 | 10/1966 | Little et al. | 15/320 |
| 3,345,671 | 10/1967 | Wilson et al. | 15/320 |
| 4,037,289 | 7/1977 | Dojan | 15/320 |

*Primary Examiner*—Christopher K. Moore
*Attorney, Agent, or Firm*—Wicks & Nemer

[57] ABSTRACT

A mobile surface cleaning machine with rear mounted steerable wheels steered by a steering wheel, first and second squeegee blades pivotally mounted on each side, respectively, on the rear of the machine. A cam carried by the rear wheels with first and second levers pivotally mounted on the machine, each of the levers having a roller mounted thereon for contact with the cam. A first flexible cable connected to the first lever and the first squeegee and a second cable connected to the second lever and said second squeegee. A sprocket carried by the cam. A chain carried by said sprocket and the steering wheel whereby actuation of the steering wheel to turn the machine in one direction lowers one of said squeegees to a surface on which the machine is operated and maintains the other squeegee raised from the machine with both squeegees maintained in raised positions when the machine is steered in a forward direction.

8 Claims, 10 Drawing Figures

FIG. 3
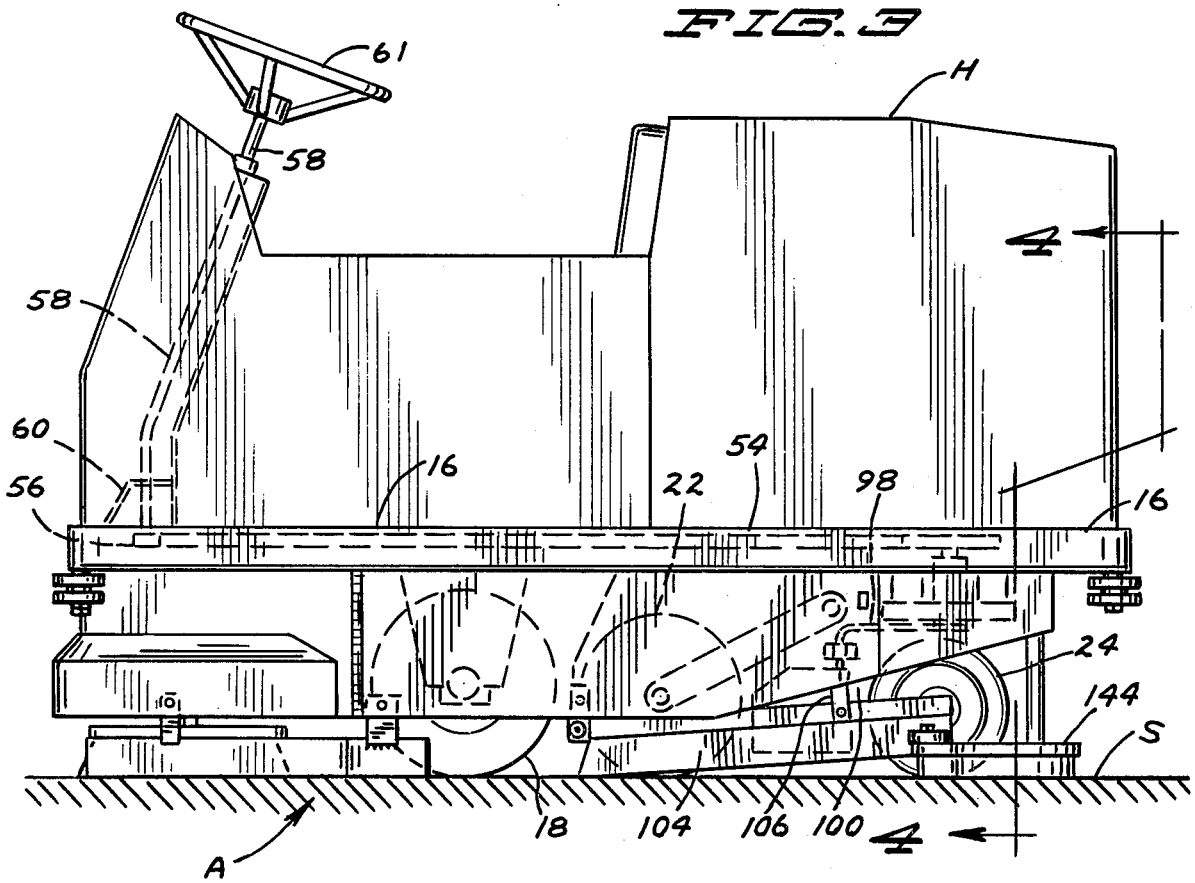
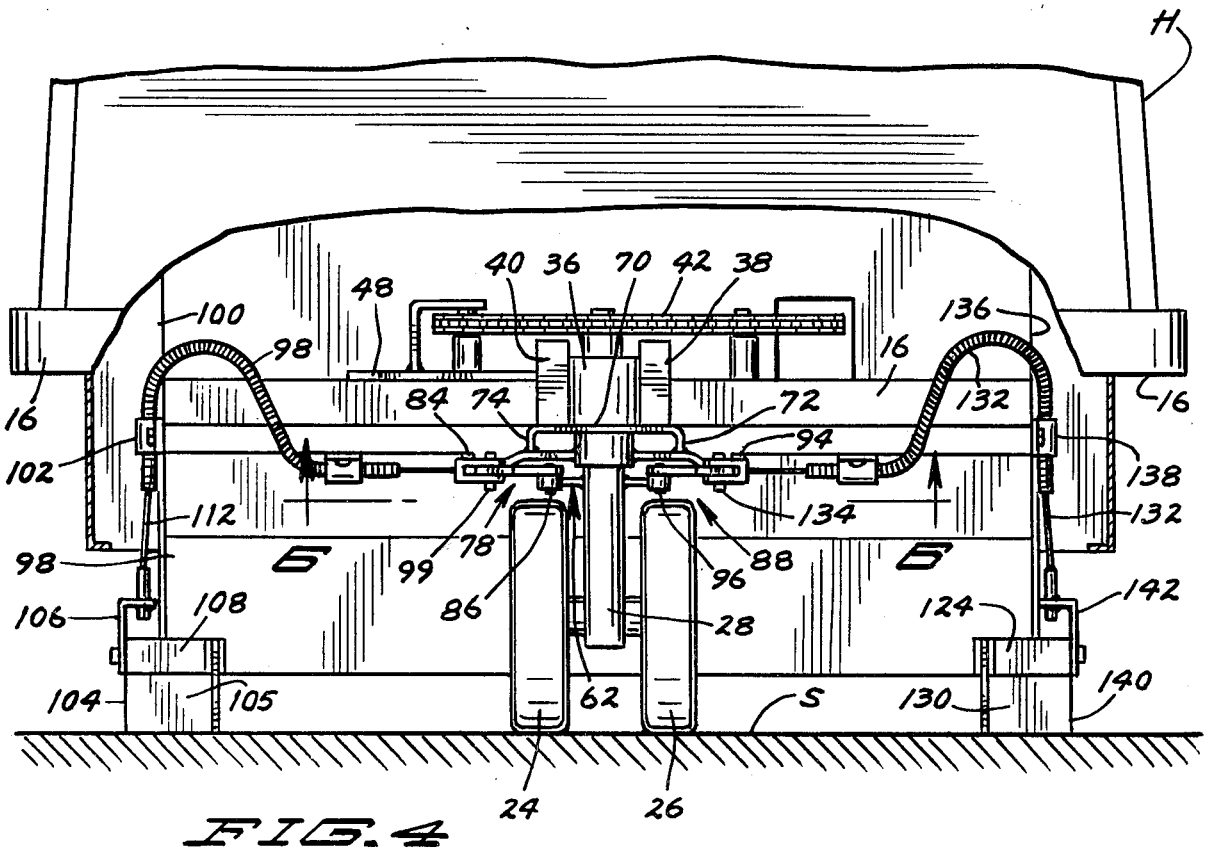
FIG. 4

MOBILE SURFACE CLEANING MACHINE HAVING SIDE MOUNTED SQUEEGEES

SUMMARY

The invention relates to an improvement in mobile surface cleaning machines and more particularly to a machine having rear mounted steering wheels with a vacuum squeegee pickup mounted to the rear of the steering wheels. In the operation of such a machine and the turning thereof, the rear mounted vacuum squeegee misses an area at the side of the machine upon the making of a turn.

It is an object of the invention to provide an elongated horizontally disposed squeegee movably mounted at each side of the machine with means, responsive to the steering apparatus for lowering one side squeegee into contact with a surface on which the machine is positioned as the machine is turned in one direction, and as the machine is turned in the other direction, the first mentioned side squeegee is raised and the other squeegee is lowered to contact the surface whereby the area missed by the rear squeegee on a turn of the machine is covered by a side squeegee. Both squeegees are held in a raised position, free of the surface, when the machine is steered in a forward direction. With both squeegees so held in raised positions, the same are free from wear when not needed in contact with a surface as is the case when the machine is driven in a forward direction. With both squeegee blades in a lowered surface-contacting position at all times the same are subject to excessive wear whereas with the present invention a squeegee blade is only lowered to surface contacting position when needed in a turn of the machine.

In the drawings forming part of this application:

FIG. 3 is a side elevational view of the machine.

FIG. 4 is a rear elevational view thereof on the line 4—4 of FIG. 3.

Figure 1:
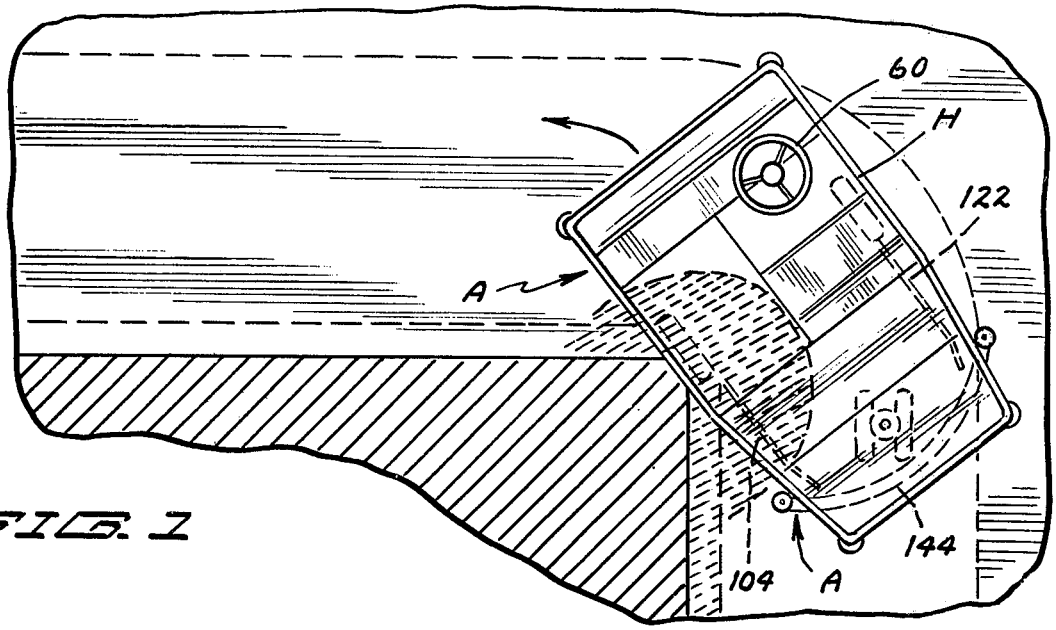
FIG. 1 is a top plan view of a mobile floor cleaning machine on combination with the invention which includes a pair of side mounted squeegees which collect debris not collected by a rear mounted vacuum squeegee as the machine is turned, the area collected by the side mounted squeegees shown in broken line cross-hatching.
Figure 2:
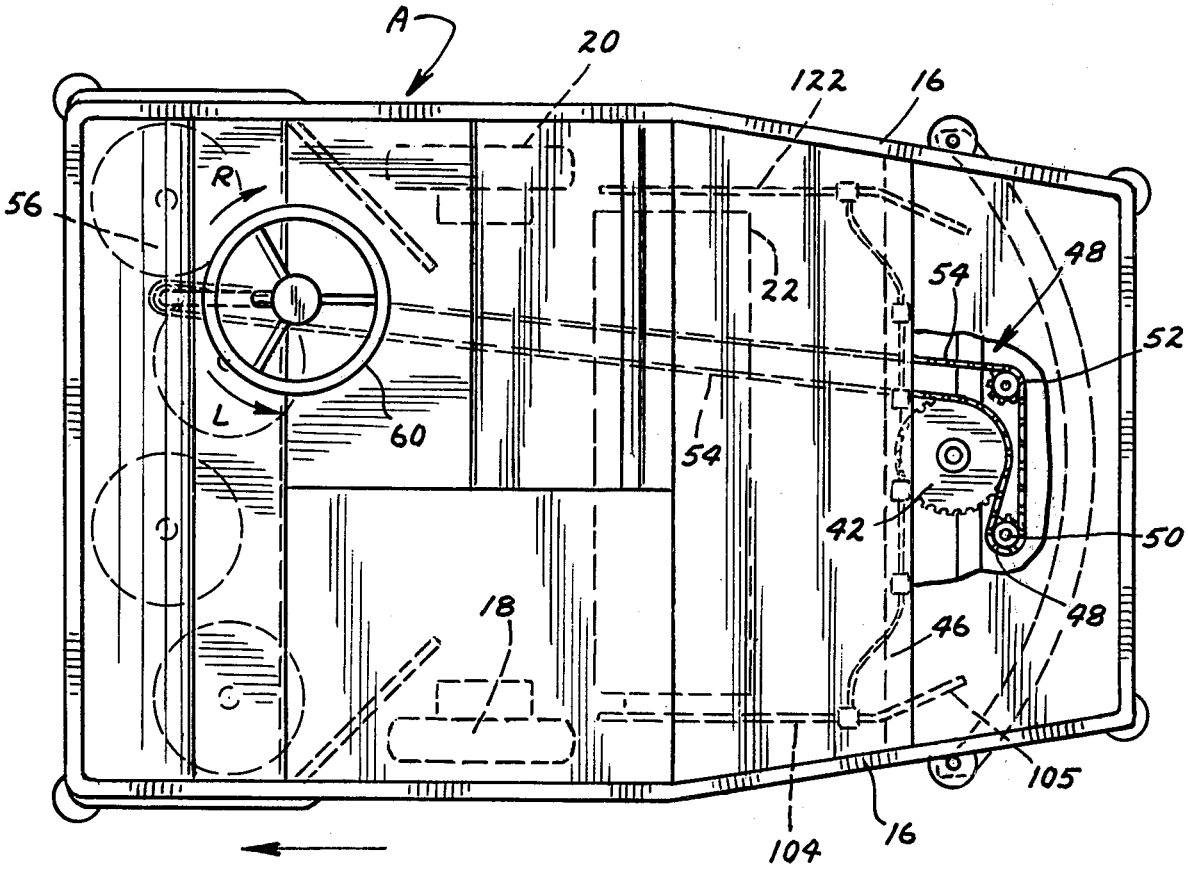
FIG. 2 is a top plan view of the machine, a portion of which is broken away.
Figure 5:
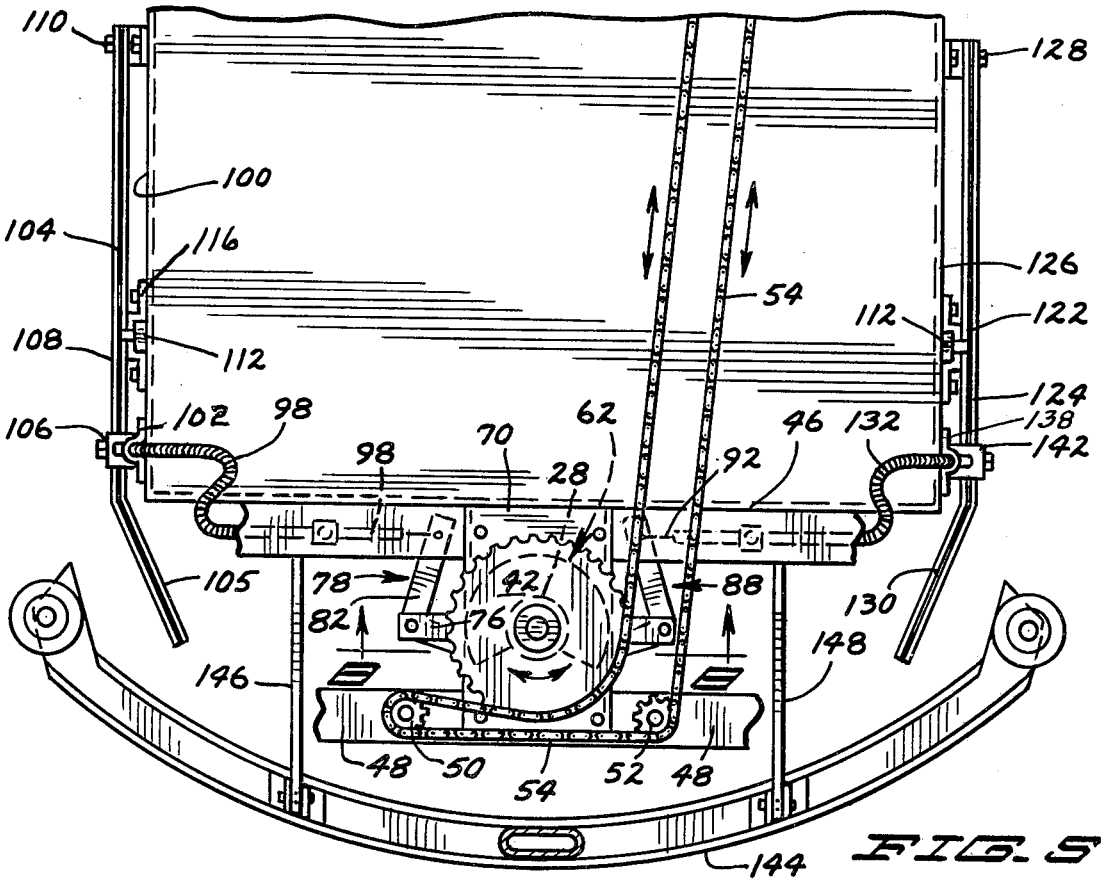
FIG. 5 is a top plan view of a rear lower portion of the machine showing the mechanism for automatically and alternatively raising and lowering the side squeegees by turning the steering wheel of the machine, portions thereof being broken away.

Referring to the drawings in detail, the floor cleaning machine A includes the conventional frame portion 16 on which is mounted the housing H. The frame 16 has mounted thereon the front wheels 18 and 20 and the pick-up cylindrical brush 22 and the steerable rear wheels 24 and 26 mounted on the rotatable post 28. The post 28 is formed with the reduced portion 30 mounted for rotation in the bearings 32 and 34 in turn mounted in the support housing 36. The housing 36 is connected to the pair of side supports 38 and 40 connected to the frame 16.

The numeral 42 designates a sprocket which is secured to the upper end of the post 28 by means of the set screw 44. Further provided are first and second spaced transverse supports 46 and 48, respectively, carried by the frame 16. Mounted on the second spaced support 48 are the first and second idler sprockets 50 and 52. A chain 54 is placed upon sprockets 50, 52 and 42 and around sprocket 56 mounted on the lower end of steering shaft 58 mounted on bracket 60. The upper end of the steering shaft 58 is equipped with the steering wheel 61 which when rotated turns the rear wheels 24 and 26 to direct the machine A in its travel over a surface.

Figure 6:
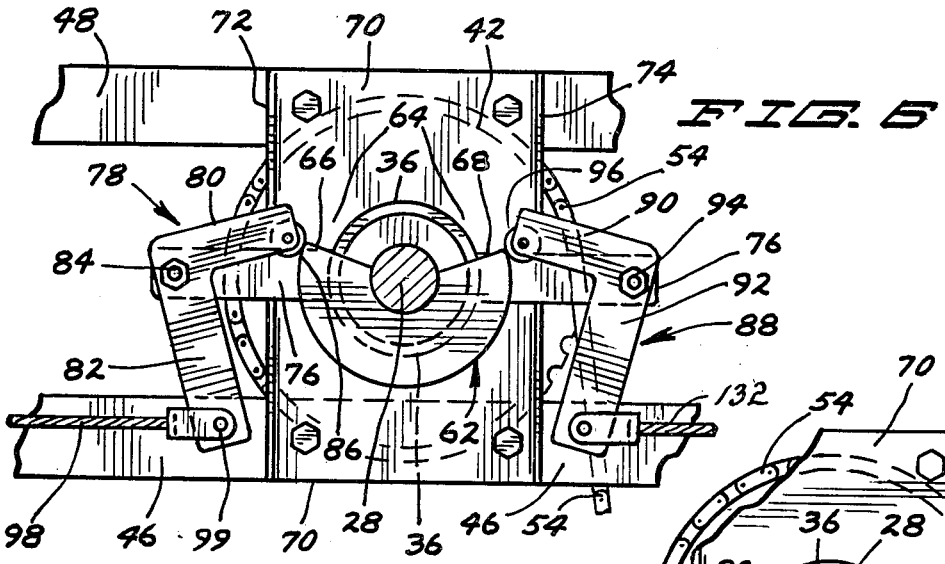
FIG. 6 is an enlarged view on the line 6—6 of FIG. 4 with the mechanism holding both side squeegees in an upward position and free of the floor surface.
Figure 7:
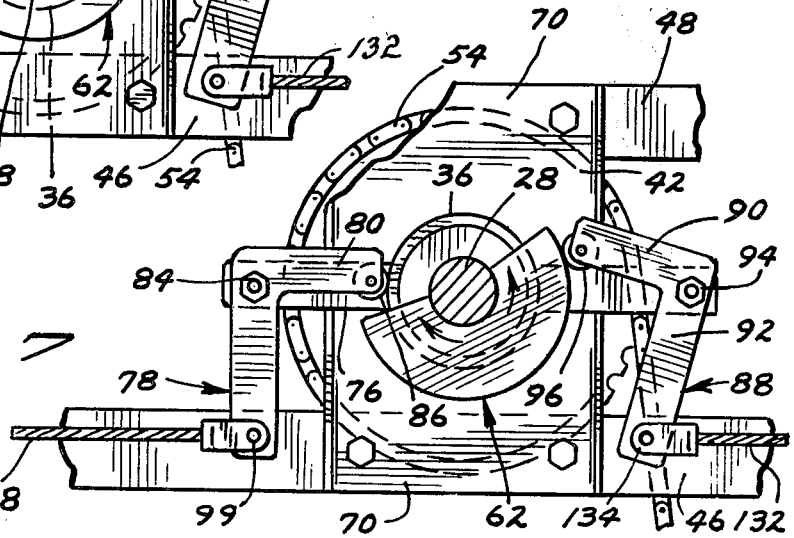
FIG. 7 is a view similar to FIG. 6 but with the mechanism thereof actuated to lower the left side squeegee into contact with the floor surface on a left turn as illustrated in FIG. 1.
Figure 8:
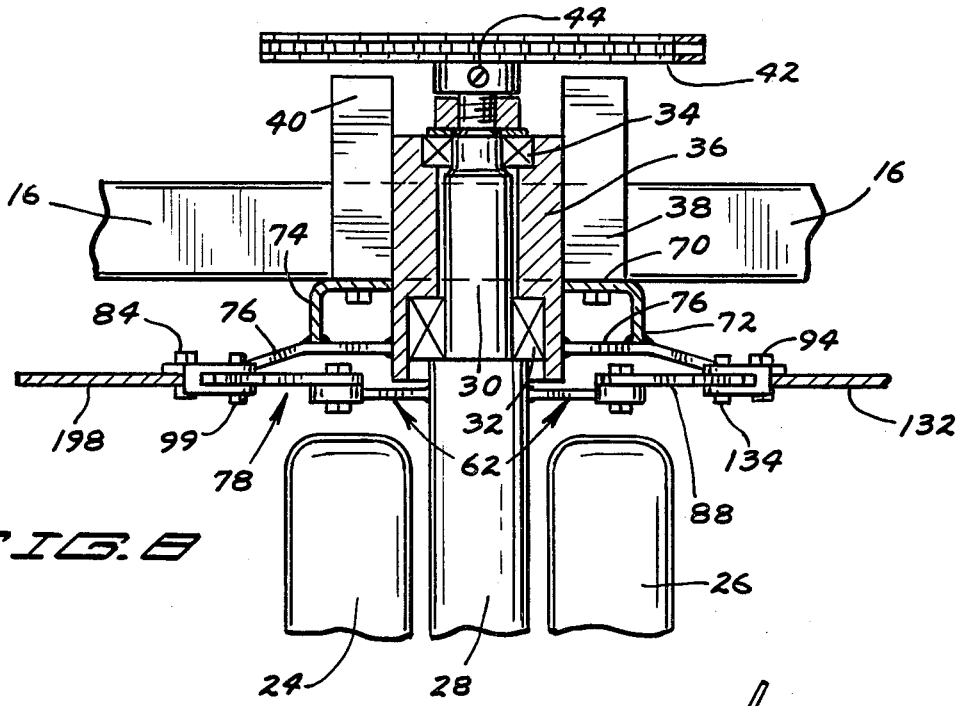
FIG. 8 is a view on the line 8—8 of FIG. 5.
Figure 9:
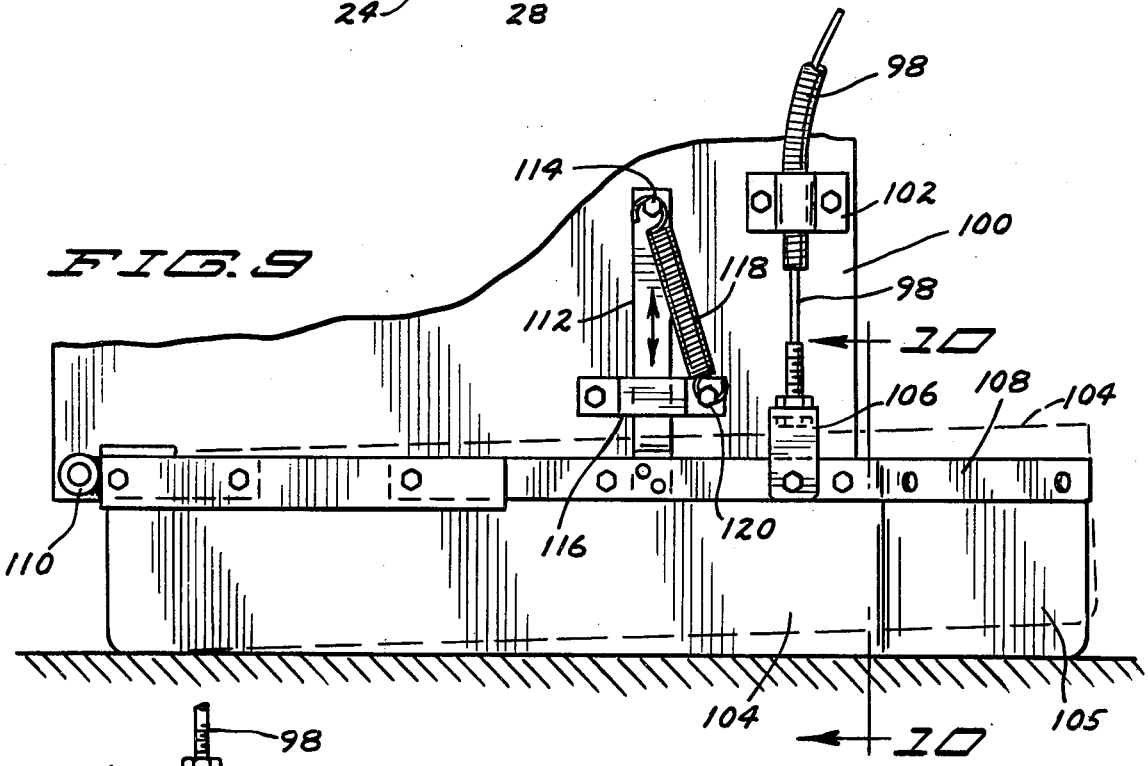
FIG. 9 is a side elevational view of a side squeegee in lowered floor contacting position with a portion of the mechanism for lowering and raising the squeegee shown, the raised position shown in broken lines.

Secured to the post 28 is the cam 62 which is substantially 195° about the surface of the post which leaves the void 64 of about 165° between the ends 66 and 68 of the cam 62, particularly FIGS. 6 and 7. The numeral 70 designates a plate having the depending sidewalls 72 and 74. The plate 70 is secured to the underside of the supports 46 and 48, and secured to the lower edges of the sidewalls 72 and 74 is the transverse bracket 76.

A first L-shaped lever 78 including the short arm portion 80 and the long arm portion 82 is pivotally mounted on one end of the transverse bracket 76 by means of the pin 84. Rotatably mounted on the outer free end of the short arm portion 80 is the roller 86 adapted to ride on or be relieved from the surface of the cam 62. A second L-shaped lever 88 including the short arm portion 90 and the long arm portion 92 is pivotally mounted on the other end of the transverse bracket 76 by means of the pin 94. A roller 96 is rotatably mounted on the outer free end of short arm portion 90 adapted to ride on or be relieved from the cam surface of cam 62.

A first flexible control cable 98 is provided which is connected at its inner end to the outer end portion of long arm 82 of lever 78 by pin 99 with the outer portion of the cable secured to the side wall 100 by the clamp 102. The outer end of the cable 98 is connected to the upper edge of the flexible left side squeegee blade 104 by means of the bracket 106 secured to the bar 108 mounting the blade 104. The front end of the bar 108 is pivotally mounted on the side wall 100 by means of the pin 110.

Secured to bar 108 is the vertical bar 112 with the pin 114 secured to the upper end of the bar. Further provided is the guide 116 secured to the wall 100 and through which the bar 112 slides. An extension spring 118 is anchored on the lower end to the pin 120 and at the upper end to the pin 114 of the bar 112 thereby normally urging the squeegee blade downwardly and upon a surface upon which the machine is positioned. The squeegee 104 has the rear end portion 105 formed at an inturned angle thereto.

A right side flexible squeegee blade 122 is provided which is identical to blade 104 and it includes the blade bar 124 to which the blade is connected. The bar 124 is pivotally connected to the wall 126 by means of the pin 128. The squeegee 122 has the rear end portion 130 formed at an inturned angle thereto.

A second flexible control cable 132 is provided which is connected at its inner end to the outer end portion of long arm 92 of lever 88 by pin 134 with the outer portion of the cable secured to the side wall 136 by the clamp 138. The outer end of the cable 132 is connected to the upper edge of the flexible left side squeegee blade 140 by means of the bracket 142 secured to the bar 124 mounting the blade 140. The blade 140 is normally urged downwardly by means of a lever, spring and guide, not shown, but identifcal to lever 112, spring 118 and guide 116.

The numeral 144 designates a conventional arcuate vacuum pickup squeegee secured to the brackets 146 and 148 at the rear end of the machine A.

OPERATION

Figure 10:
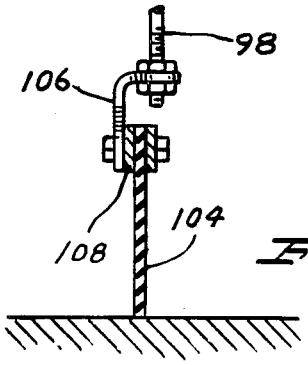
FIG. 10 is a view on the line 10—10 of FIG. 9.

As the steering wheel 61 is rotated counter clockwise for a left turn of the machine the sprocket 62 is rotated clockwise as is the cam 62. As a result the roller 86 of lever 78 rides off cam 62 and free thereof, particularly FIG. 7 whereby cable 98 is relieved and side squeegee 108 is lowered to the position, in full lines, of FIG. 10 due to the spring 118. At the same time roller 96 of lever 88 remains on the cam 62 as in FIG. 7 thereby maintaining the cable 132 in a tightened condition whereby side squeegee 124 remains in a raised position.

When the steering wheel 60 is rotated clockwise to steer the machine to the right, the cam 62 is rotated whereby roller 96 runs off the cam and free thereof which relaxes cable 132 which in turn allows the right side squeegee to lower and contact surface S due to the downward pull of a spring identical to spring 118. At the same time, roller 86 remains upon the cam 62 thereby maintaining the blade 104 in a raised position. Thus, as the machine is turned to the left, the left side squeegee blade 104 is lowered whereby the shaded area of FIG. 1 is wiped by the blade 104. The opposite occurs when the machine is turned to the right. With the machine steered to make a U-turn in either direction the side squeegees function as above in either direction of turn.

Having thus described the invention, what is claimed as new and desired to be secured by Letters Patent is:

1. A mobile surface cleaning machine having a frame mounting floor treating members, rear steering wheels with steering means therefore, and a rear mounted vacuum pickup, the improvement including a squeegee mounted on each side of the frame, said improvement comprising:

(a) a first squeegee,
(b) means movably mounting said first squeegee on one side of said frame,
(c) a second squeegee,
(d) means movably mounting said second squeegee on the other side of said frame, said first and second squeegees being in a raised position when the machine is in forward travel,
(e) means for lowering said first squeegee to a surface on which the machine is positioned and maintaining said second squeegee in a raised position from the surface responsive to said steering means being operated to turn said machine from a straight ahead direction in the direction of said one side of said frame and maintaining said first squeegee in a raised position and lowering said second squeegee to a surface when said steering means is operated to turn said machine from a straight ahead direction in the direction of said other side of said frame.

2. The device of claim 1 in which said means movably mounting a squeegee on each side of said frame includes a pivot connecting one end of each squeegee to the frame for pivotal movement relative thereto.

3. The device of claim 1 in which said means for lowering and raising each of said squeegees includes:

(a) first and second levers pivotally carried by said frame,
(b) means connecting said first lever to said first squeegee,
(c) means connecting said second lever to said second squeegee,
(d) a cam,
(e) said cam carried by and rotatable with said steering means and contactable by each of said levers for actuation of the levers to thereby raise and lower said squeegees when said steering means is actuated.

4. The device of claim 3 in which said means connecting each of said first and second levers to each of said first and second squeegees includes an elongated flexible member.

5. The device of claim 3 in which said cam rotatably carried by said steering means includes (a) a post rotatably carried by said frame and mounting said cam,
(b) said post mounting said rear steering wheels.

6. A mobile surface cleaning machine comprising in combination:

(a) a frame having floor treating members thereon and,
(b) wheels mounted on the frame,
(c) steering wheels,
(d) means pivotally mounting said steering wheels on the rear of said frame,
(e) a first squeegee for cleaning a surface treated by said floor treating members,
(f) means movably mounting said first squeegee on one side of said frame, p1 (g) a second squeegee for cleaning a surface treated by said floor treating members,
(h) means movably mounting said second squeegee on the other side of said frame,
(i) a cam carried by said means pivotally mounting said steering wheels,
(j) steering means carried by said frame,
(k) first and second levers pivotally carried by said frame each contactable by said cam,
(l) means connecting said first lever to said first squeegee for moving said first squeegee when said cam is actuated to contact said first lever,
(m) means connecting said second lever means to said second squeegee for moving said second squeegee when said cam is actuated to contact said second lever,
(n) said steering means connected to said cam whereby actuation of said steering means actuates said steering wheels in a direction towards one side of said frame and lowers said first squeegee to a surface while raising said second squeegee, said steering means when actuated to direct said wheels towards the other side of said frame lowers said second squeegee and raises said first squeegee, both of said squeegees being maintained in a raised condition when the machine is operated in a straight ahead direction.

7. The device of claim 6 in which said means movably mounting each of said first and second squeegees on said frame includes a pivot.

8. A mobile surface cleaning machine comprising in combination:

(a) a frame having floor treating members thereon, (b) support wheels mounted on said frame, (c) steering wheels mounted on said frame, (d) means for steering said steering wheels, (e) a first squeegee movably mounted on one side of said frame, (f) a second squeegee movably mounted on the opposite side of said frame, (g) means connecting said steering means with said first and second squeegees for lowering said first squeegee and raising said second squeegee when said steering means is operated to direct said steering wheels toward one side of said frame and raising said first squeegee and lowering said second squeegee when said steering means is operated to direct said steering wheels toward the other side of said frame, both of said squeegees being maintained in a raised condition when the machine is operated in a straight ahead direction.

* * * * *